US005458793A

United States Patent [19]

Adams et al.

[11] Patent Number: 5,458,793

[45] Date of Patent: Oct. 17, 1995

[54] COMPOSITIONS USEFUL AS ADDITIVES FOR LUBRICANTS AND LIQUID FUELS

[75] Inventors: Paul E. Adams, Willoughby Hills; Richard M. Lange, Euclid; Stephen H. Stoldt, Concord Township, all of Ohio

[73] Assignee: The Lubrizol Corporation, Wickliffe, Ohio

[21] Appl. No.: 61,378

[22] Filed: May 13, 1993

[51] Int. Cl.[6] ..... C10M 133/38; C07D 233/00

[52] U.S. Cl. ..... 252/47; 252/47.5; 252/515 R; 548/146; 548/148; 548/215; 548/217; 548/300.1; 548/311.1; 548/312.7

[58] Field of Search ..... 548/146, 148, 548/215, 300.1, 311.1; 252/47

[56] References Cited

U.S. PATENT DOCUMENTS

| | | | |
|---|---|---|---|
| 2,754,216 | 7/1956 | Chenicek | 252/51.5 R |
| 2,899,441 | 8/1959 | Dornfeld | 548/348.1 |
| 3,089,761 | 5/1963 | Andress et al. | 44/336 |
| 3,251,853 | 5/1966 | Hoke | 260/309.6 |
| 3,360,464 | 12/1967 | Otto, Jr. | 252/51.5 |
| 3,445,386 | 5/1969 | Otto et al. | 252/32.7 |
| 3,467,658 | 9/1969 | Lipha | 548/300.1 |
| 3,886,147 | 5/1975 | Wehrmeister | 548/146 |
| 3,954,808 | 5/1976 | Elliott et al. | 260/343.2 |
| 3,965,114 | 6/1976 | van der Burg | 548/300.1 |
| 3,966,807 | 6/1976 | Elliott et al. | 260/559 |
| 3,974,147 | 8/1976 | Tiers et al. | 548/146 |
| 4,046,802 | 9/1977 | Elliott et al. | 560/61 |
| 4,051,049 | 9/1977 | Elliott et al. | 252/51.5 |
| 4,136,188 | 1/1979 | Ishikawa et al. | 514/401 |
| 4,234,435 | 11/1980 | Meinhardt et al. | 252/51.5 |
| 4,247,300 | 1/1981 | Bonazza et al. | 44/63 |
| 4,977,171 | 12/1990 | Suzuki et al. | 548/146 |
| 5,039,436 | 8/1991 | Adams | 252/47 |
| 5,089,513 | 2/1992 | Bird et al. | 548/146 |
| 5,096,902 | 3/1992 | Nádor et al. | 548/146 |

FOREIGN PATENT DOCUMENTS

| | | |
|---|---|---|
| 2219181 | 9/1974 | France . |
| 2355498 | 1/1978 | France . |
| 1008649 | 11/1965 | United Kingdom . |
| 1010568 | 11/1965 | United Kingdom . |
| 93/21143 | 10/1993 | WIPO . |

*Primary Examiner*—Ellen M. McAvoy
*Attorney, Agent, or Firm*—Joseph P. Fischer; Frederick D. Hunter; James L. Cordek

[57] ABSTRACT

A composition useful as a lubricating oil or fuel additive comprising at least one compound of the formula (I)

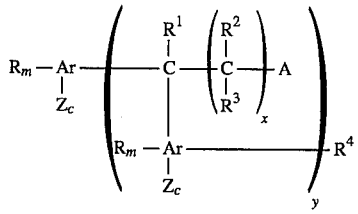

wherein each Ar is independently an aromatic group having from 4 to about 30 carbon atoms and from 0 to 3 optional substituents, each R is independently hydrocarbyl, $R^4$ is a monovalent terminating group, each m is independently an integer ranging from 0 to about 10, x ranges from 0 to about 8, each Z is independently OH, lower alkoxy, $(OR^5)_bOR^6$ or $0^- R^1$, $R^2$, $R^3$, and $R^6$ are each independently, H or hydrocarbyl, b ranges from 1 to about 30, c from 1 to about 3, and y from 1 to about 10, the sum m+c does not exceed the number of valences of the corresponding Ar available for substitution and at least one A is the group (II)

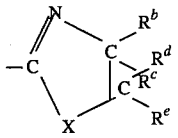

wherein each $R^b$, $R^c$, $R^d$ and $R^e$ is independently H, hydroxyhydrocarbyl or hydrocarbyl, X is O, S or $NR^a$ wherein $R^a$ is H, hydrocarbyl, hydroxyhydrocarbyl, aminohydrocarbyl or $$\leftarrow Y \rightarrow_a R^5 - D \quad \text{(III)}$$

wherein each Y is $$-R^5-\underset{\underset{R^7}{|}}{N}- \quad \text{or} \quad -R^5O-,$$

each $R^5$ is independently a divalent hydrocarbyl group, each $R^7$ is H, alkoxyalkyl, hydroxyalkyl, hydrocarbyl, aminohydrocarbyl, or N-alkoxyalkyl- or hydroxyalkyl-substituted amino-hydrocarbyl, a is a number ranging from 0 to about 100 and D is (IV)

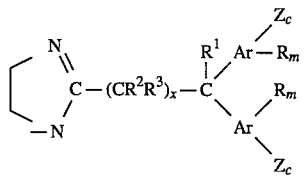

34 Claims, No Drawings

COMPOSITIONS USEFUL AS ADDITIVES FOR LUBRICANTS AND LIQUID FUELS

FIELD OF THE INVENTION

This invention is directed to novel fuel compositions for internal combustion engines and to methods for using such fuel compositions, novel lubricating oil compositions and novel nitrogen containing compositions.

BACKGROUND OF THE INVENTION

Over the years, fuels used in internal combustion engines have contained various kinds of additives to improve performance of the fuel or to alleviate problems arising during the use and combustion of fuels in internal combustion engines. During the 1950's and 1960's, engine designers generally focused their efforts towards the development of high-performance engines, with little concern about fuel economy or exhaust emissions. The fuel delivery system for engines of this era involved the use of carburetors to deliver an air-fuel mixture, via a manifold, to the cylinders for combustion. Primary concerns at this time were carburetor icing, adequate octane value, deposit formation on carburetor surfaces, fuel stability and the like. Additives for fuels such as anti-icing agents, lead-containing fuel additives, detergents, and various antioxidants generally resulted in adequate performance. Deposits in other parts of the fuel delivery system were not of a major concern because such engines were generally tuned to a rich air/fuel ratio allowing for mixture malfunction. Greater power-weight ratios meant that the driver was less apt to notice changes in peak power and fuel economy, and exhaust emissions were not a serious concern at that time.

It wasn't until the energy shortages of the 1970's, and, at about the same time, increased awareness of environmental concerns, that changes directed to purposes other than improving engine output began to receive widespread attention. During this time, and up to the early 1980's, government regulations in the United States and in other countries throughout the world imposed increasingly stringent limitations on exhaust emissions and on fuel consumption. Efforts to comply with these requirements involved various engine modifications, smaller vehicles, smaller engines, and increasingly widespread use of light weight materials. Only minor changes were made to fuel handling systems during this time other than efforts to control evaporative hydrocarbon emissions. During this time, consumers did become aware of the importance of fuel intake system cleanliness to maintain acceptable fuel consumption limits.

By the early 1980's, the carbureted internal combustion engine began to give way to throttle-body fuel injection systems. Such systems are described in U.S. Pat. Nos. 4,487,002 and 4,490,792 and in Bowler, SAE Paper 800164. Conventional fuel additives generally provided adequate service for this system.

In response to continuing demands for improved fuel economy, increased performance and reduced exhaust emissions, automobile manufacturers began to utilize even more sophisticated engines. One of the developments was the increased use of high specific output, lean burn engines. To meet the complex demands of increased power, fuel economy, and environmental control, these engines were tuned to operate at or near the lean limit of combustion, i.e., minimum amount of fuel. Lean burn engines require precise management of air-fuel ratios. This resulted in engines much less tolerant of deposits throughout the fuel metering and induction system. Thus, total fuel intake system cleanliness has become an important priority. Further developments in fuel metering and induction systems have resulted in engines that can operate efficiently and provide excellent performance while generating minimal objectionable emissions or emissions that are readily controlled with emission control systems such as catalysts and the like. One such development is the increasingly widespread use of fuel injection systems such as port fuel injection, also known as multi-port fuel injection, in which injectors discharge fuel into an intake runner or intake port. Such injector systems are illustrated in U.S. Pat. No. 4,782,808, the disclosure of which is hereby incorporated herein by reference thereto. Each injector is normally located in close proximity to the intake valve. The injector itself is designed to close tolerances and is subject to fouling, for example, from the fuel itself or because its location, in close proximity to the intake valve, is in an environment of high temperature resulting in carbon and varnish deposit formation on the injector. Such deposits result in impaired control of fuel metering. When deposits form on the injector tip, the injector may clog, causing reduction in fuel flow or at least the precise fuel spray pattern is disrupted.

Another problem that has arisen is the formation of deposits on the intake valve itself. One of the reasons proposed for the particularly severe formation of deposits in port fuel injections engines is that the fuel is sprayed upon the hot valve surface resulting in formation of carbon deposits on the valve surface.

While earlier engines were sometimes prone to the formation of deposits throughout the intake system, including on the intake valve itself, the less demanding requirements of engines operating on a rich fuel mixture tended to mask the detrimental effect on driveability. Today's more sophisticated engines often are very intolerant of such deposits, resulting in severe driveability problems such as rough idling, power loss and stalling.

The use of large amounts of conventional dispersing additives in an attempt to overcome some of these stated problems often resulted in increased deposits on the intake valve and also in valve sticking. It has been proposed that degradation of the fuel additive results in deposits that impair movement of the valve.

Accordingly, efforts are continuing to provide means for maintaining intake system cleanliness or to clean up intake systems which are already contaminated.

It is also desirable to improve the performance of lubricating oil compositions by incorporating therein performance-improving amounts of chemical additives.

It is also desirable to provide novel chemical compounds that are useful as additives for fuel and lubricating oil compositions.

It is one object of this invention to provide novel fuel compositions.

It is another object of this invention to provide novel fuel compositions that promote total intake system cleanliness.

It is another object to provide novel fuel compositions for use in port fuel injected engines that prevent or reduce the formation of intake valve deposits.

Another object is to provide novel fuel compositions that meet at least one of the above-stated objects and do not contribute towards valve-sticking.

A further object is to provide a method for maintaining total intake system cleanliness in a gasoline-fueled internal combustion engine.

Still another object is to provide a method for preventing or reducing the formation of intake valve deposits in a port fuel injected engine, or for removing such deposits where they have formed.

A further object is to provide a method for preventing or reducing deposits on fuel injectors, particularly, deposits at the fuel delivery nozzle thereof.

Another object is to provide novel lubricating oil compositions.

Yet another object is to provide novel chemical compounds that are useful for improving the performance of lubricating oils and normally liquid fuels.

Other objects are mentioned hereinbelow or will be apparent to one skilled in the applicable art upon reading the disclosure.

SUMMARY OF THE INVENTION

The present invention is directed to compositions comprising at least one compound of the general formula (I)

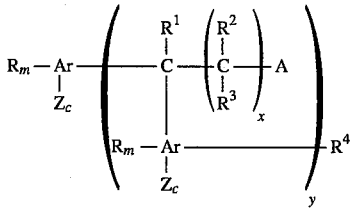

wherein each Ar is independently an aromatic group having from 5 to about 30 carbon atoms having from 0 to 3 optional substituents selected from the group consisting of amino, hydroxy- or alkyl- polyoxyalkyl, nitro, aminoalkyl, carboxy or combinations of two or more of said optional substituents, each R is independently a hydrocarbyl group, $R^1$ is H or a hydrocarbyl group, $R^2$ and $R^3$ are each, independently, H or a hydrocarbyl group, $R^4$ is selected from the group consisting of H, a hydrocarbyl group, a member of the group of optional substituents on Ar or lower alkoxy, each m is independently 0 or an integer ranging from 1 to about 6, x ranges from 0 to about 8, and each Z is independently OH, lower alkoxy, $(OR^5)_bOR^6$ or $O^-$ wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution and each A is independently an amide or an amide-containing group, a carboxyl group, an ester group, an acylamino group or a group characterized by the formula (II)

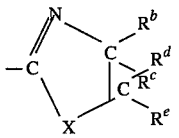

wherein $R^b$, $R^c$, $R^d$ and $R^e$ are each independently H, hydroxyhydrocarbyl or hydrocarbyl groups, and X is O, S or $NR^a$ wherein $R^a$ is H, hydrocarbyl, hydroxyhydrocarbyl, aminohydrocarbyl or a group of the formula (III)

wherein each Y is a group of the formula $$-R^5-\underset{\underset{R^7}{|}}{N}- \quad \text{or} \quad -R^5O-$$

each $R^5$ is a divalent hydrocarbyl group, each $R^7$ is H, alkoxyalkyl, hydroxyalkyl, a hydrocarbyl group, an aminohydrocarbyl group, or an N-alkoxyalkyl- or hydroxyalkyl- substituted aminohydrocarbyl group, a is 0 or a number ranging from 1 to about 100 and D is a group of the formula (IV)

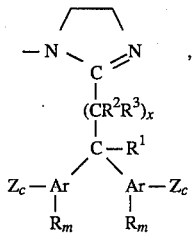

or when one Z and A are taken together, a lactone group of the formula (V)

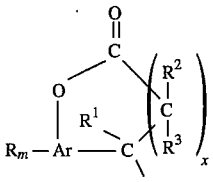

provided at least one A is a group of formula (II).

In one embodiment, the compound of formula (I) is present in fuel compositions comprising a major amount of normally liquid fuel, preferably in amounts sufficient to provide total fuel intake system cleanliness. In another embodiment, it is present in amounts sufficient to prevent or to reduce the formation of intake valve deposits or to remove same where they have formed. The presence of an additional component, a fluidizer oil, has been found to be helpful in providing enhanced detergency and reduced valve-sticking. In yet another embodiment, the fuel compositions of this invention comprise an auxiliary dispersant selected from the group consisting of Mannich type dispersants, acylated nitrogen-containing dispersants, ester dispersants, aminophenol dispersants, aminocarbamate dispersants and amine dispersants. Methods for providing total intake system cleanliness and preventing or reducing the formation of intake valve deposits or removing same, are within the scope of this invention.

In another embodiment, the compounds of this invention are used in performance improving amounts in oils of lubricating viscosity.

A "major amount" is defined herein as greater than 50% by weight, and a "minor amount" is less than 50% by weight. Thus, for example, 51%, 60%, 77% and 99% are major amounts, and 0.01%, 10%, 24% and 49% are minor amounts.

DESCRIPTION OF THE PREFERRED EMBODIMENTS DETAILED DESCRIPTION OF THE INVENTION

As mentioned hereinabove, compositions of this invention comprise compounds represented by the general formula (I). Specific features and embodiments are discussed hereinbelow.

The Aromatic Moiety Ar

The group Ar is an aromatic group containing from 5 to about 30 carbon atoms having from 0 to 3 optional substituents selected from the group consisting of amino, hydroxy- or alkyl- polyoxyalkyl, nitro, aminoalkyl, carboxy or combinations of two or more of said optional substituents.

The aromatic group Ar can be a single aromatic nucleus such as a benzene nucleus, a 1,2,3,4-tetrahydronaphthalene nucleus, etc., or a polynuclear aromatic moiety. Polynuclear moieties can be of the fused type; that is, wherein at least one aromatic nucleus is fused at two points to another nucleus as in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, carbonyl group containing linkages, sulfide linkages, polysulfide linkages of 2 to 6 sulfur atoms, sulfinyl linkages, sulfonyl linkages, methylene linkages, alkylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by one methylene linkage and one covalent bond. Such a nucleus may be considered to have 3 nuclei but only two of them are aromatic. More often, Ar will contain only carbon atoms in the aromatic nucleus per se. When Ar contains only carbon atoms in the aromatic nucleus, it will contain at least 6 carbon atoms.

Specific examples of single ring Ar moieties are the following:

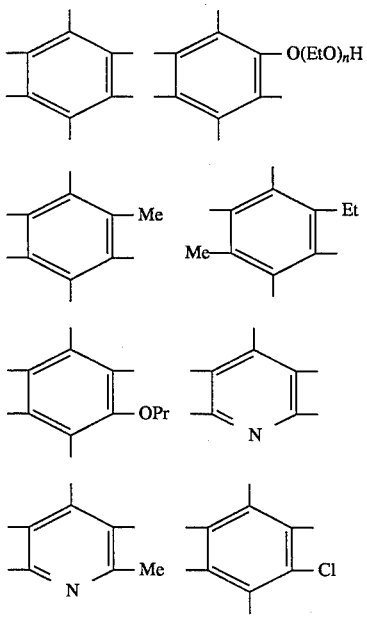

-continued

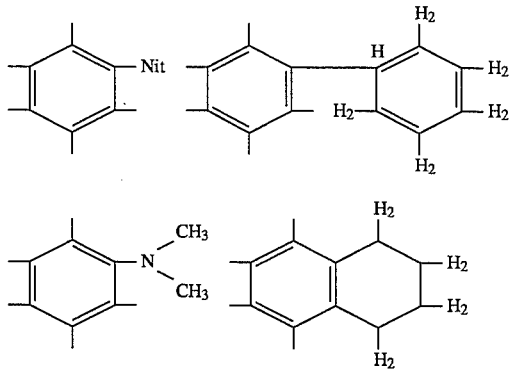

etc., wherein Me is methyl, Et is ethyl or ethylene, as appropriate, Pr is n-propyl, and Nit is nitro.

Specific examples of fused ring aromatic moieties Ar are:

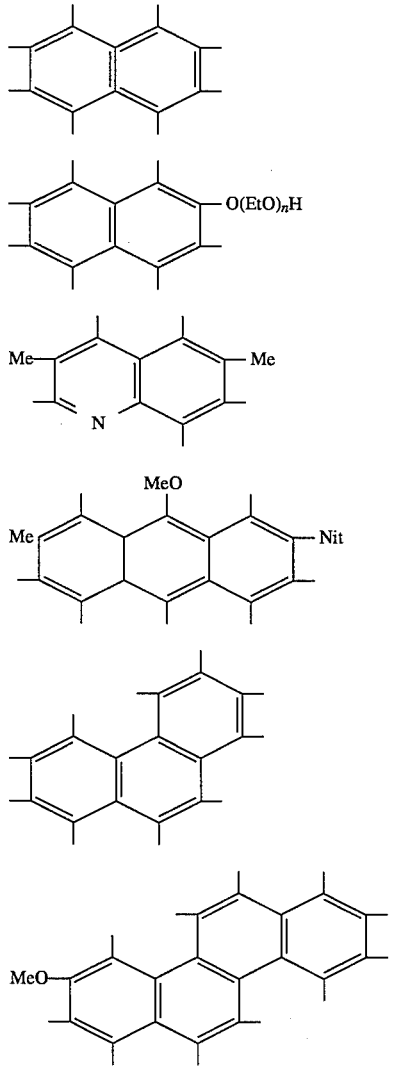

etc.

When the aromatic moiety Ar is a linked polynuclear aromatic moiety, it can be represented by the general formula $$ar\text{-}(L-ar)_w$$

wherein w is an integer of 1 to about 6, each ar is a single ring or a fused ring aromatic nucleus of 5 to about 12 carbon atoms and each L is independently selected from the group consisting of carbon-to-carbon single bonds between ar nuclei, ether linkages (e.g. —O—), keto linkages $$(\text{e.g., } -\overset{\overset{\displaystyle O}{\|}}{C}-),$$

sulfide linkages (e.g., —S—), polysulfide linkages (e.g., $—S—_{2\text{-}6}$), sulfinyl linkages (e.g., —S(O)—), sulfonyl linkages (e.g., $—S(O)_2—$), lower alkylene linkages $$(\text{e.g., } -CH_2-,\ -CH_2-CH_2-,\ -CR^\circ{}_2-,\ -CH-\underset{\underset{\displaystyle R^\circ}{|}}{CH}-),$$

lower alkylene ether linkages $$(\text{e.g., } -CH_2O-,\ -CH_2O-CH_2-,\ -CH_2-CH_2O-,\ -CH_2CH_2OCH_2CH_2-,\ -CH_2\underset{\underset{\displaystyle R^\circ}{|}}{CH}OCH_2\underset{\underset{\displaystyle R^\circ}{|}}{CH}-,$$

$$-CH_2\underset{\underset{\displaystyle R^\circ}{|}}{CH}O\underset{\underset{\displaystyle R^\circ}{|}}{CH}CH_2-,\ \text{etc.}),$$

lower alkylene sulfide linkages (e.g., wherein one or more —O—'s in the lower alkylene ether linkages is replaced with a S atom), lower alkylene polysulfide linkages (e.g., wherein one or more —O— is replaced with a $—S—_{2\text{-}6}$ group), amino linkages (e.g., $$-\underset{\underset{\displaystyle H}{|}}{N}-,\ -\underset{\underset{\displaystyle R^\circ}{|}}{N}-,$$

$—CH_2N—$, $—CH_2NCH_2—$,

—alk-N—, where alk is lower alkylene, etc.), polyamino linkages (e.g., $—N(alkN)_{1\text{-}10}$, where the unsatisfied free N valences are taken up with H atoms or R° groups), linkages having the formula (VI)

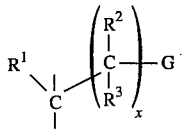

wherein each of $R^1$, $R^2$ and $R^3$ is independently H or hydrocarbyl, preferably H or alkyl or alkenyl, most preferably lower alkyl or H, each G is independently an amide or an amide-containing group, a carboxyl group, an ester group, an oxazoline-containing group, a thiazoline containing group, or an imidazoline-containing group and x is an integer ranging from 0 to about 8, and mixtures of such bridging linkages (each R° being a lower alkyl group).

Specific examples of linked moieties are:

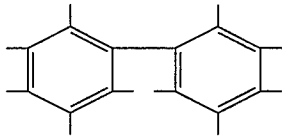

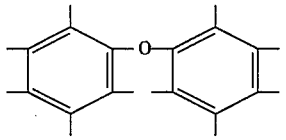

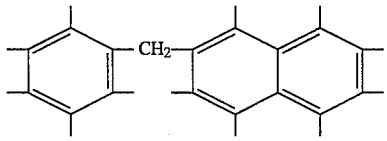

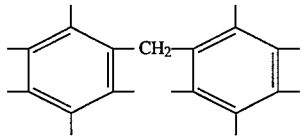

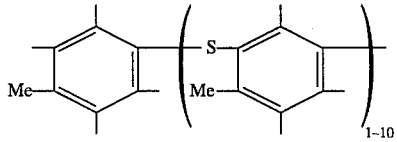

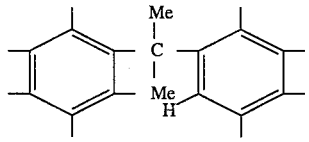

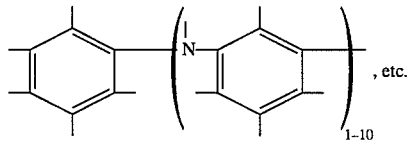

, etc.

Usually all of these Ar groups have no substituents except for the R and Z groups (and any bridging groups).

For such reasons as cost, availability, performance, etc., Ar is normally a benzene nucleus, a lower alkylene bridged benzene nucleus, or a naphthalene nucleus. Most preferably, Ar is a benzene nucleus.

The Group R

The compounds of formula (I) employed in the compositions of the present invention preferably contain, directly bonded to at least one aromatic group Ar, at least one group R which, independently, is a hydrocarbyl group. More than one hydrocarbyl group can be present, but usually no more than 2 or 3 hydrocarbyl groups are present for each aromatic nucleus in the aromatic group Ar.

The number of R groups on each Ar group is indicated by the subscript m. For the purposes of this invention, each m may be independently 0 or an integer ranging from 1 up to about 6 with the proviso that m does not exceed the number of valences of the corresponding Ar available for substitution. Frequently, each m is independently an integer ranging from 1 to about 3. In an especially preferred embodiment each m equals 1.

Each R frequently contains up to about 750 carbon atoms, more frequently from 4 to about 750 carbon atoms, preferably from 4 to about 400 carbon atoms and more preferably from 4 to about 100 carbons. R is preferably an aliphatic group, more preferably alkyl or alkenyl, preferably alkyl or substantially saturated alkenyl. In one preferred embodiment, R is aliphatic and contains at least about 6 carbon atoms, often from 8 to about 100 carbons. In another embodiment, each aliphatic R contains an average of at least about 30 carbon atoms, often an average of from about 30 to about 100 carbons. In another embodiment, R is aliphatic and contains from 12 to about 50 carbon atoms. In a further embodiment, R is aliphatic and contains from about 7 to about 28 carbon atoms, preferably from 12 to about 24 carbon atoms and more preferably from 12 to about 18 carbon atoms. In another preferred embodiment, R contains from about 16 to about 28 carbon atoms. In one embodiment, at least one R is derived from an alkane or alkene having number average molecular weight ranging from about 300 to about 800. In another embodiment, R is aliphatic and contains an average of at least about 50 carbon atoms. When R contains fewer than 16 carbon atoms, it is often preferred that R is substantially linear, that is, it contains no more than 3, preferably no more than one, most preferably, no branching group from the main chain. However, in one preferred embodiment m is 2, each Ar contains at least one tertiarybutyl group and the other R group contains from 4 to about 100 carbon atoms, for example a 2,4-di-t-butyl phenol.

When the group R is an alkyl or alkenyl group having from 2 to about 28 carbon atoms, it is typically derived from the corresponding olefin; for example, a butyl group is derived from butene, an octyl group is derived from octene, etc. The corresponding olefin may be derived from lower olefins, e.g., a propylene tetramer, etc. When R is a hydrocarbyl group having at least about 30 carbon atoms, it is frequently an aliphatic group, preferably an alkyl or alkenyl group, made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-olefins. These aliphatic hydrocarbyl groups may also be derived from halogenated (e.g., chlorinated or brominated) analogs of such homo- or interpolymers. R groups can, however, be derived from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the R groups may be reduced or eliminated by hydrogenation according to procedures known in the art.

In one preferred embodiment, at least one R is derived from polybutene. In another preferred embodiment, R is derived from polypropylene.

As used herein, the term "hydrocarbyl or hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon, groups. Substantially hydrocarbon describes groups, including hydrocarbon based groups, which contain non-hydrocarbon substituents, or non-carbon atoms in a ring or chain, which do not significantly alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur and nitrogen, or substituents, which include, for example, hydroxyl, alkoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic-substituted aromatic groups and the like as well as cyclic groups wherein the ring is completed through another portion of the molecule (that is, for example, any two indicated groups may together form an alicyclic radical);

(2) substituted hydrocarbon groups, that is, those groups containing non-hydrocarbon-containing substituents which, in the context of this invention, do not significantly alter the predominantly hydrocarbon character; those skilled in the art will be aware of such groups (e.g., hydroxy, alkoxy, mercapto, alkylmercapto, nitro, nitroso, sulfoxy, etc.);

(3) hetero groups, that is, groups which will, while having a predominantly hydrocarbon character within the context of this invention, contain atoms other than carbon present in a ring or chain otherwise composed of carbon atoms. Suitable heteroatoms will be apparent to those of ordinary skill in the art and include, for example, sulfur, oxygen, nitrogen. Such groups as, e.g., pyridyl, furyl, thienyl, imidazolyl, etc. are representative of heteroatom containing cyclic groups.

Usually the hydrocarbyl groups are purely hydrocarbon and contain substantially no such non-hydrocarbon groups, substituents or heteroatoms.

Preferably, hydrocarbyl groups R are substantially saturated. By substantially saturated it is meant that the group contains no more than one carbon-to-carbon unsaturated bond, olefinic unsaturation, for every ten carbon-to-carbon bonds present. Usually, they contain no more than one carbon-to-carbon non-aromatic unsaturated bond for every 50 carbon-to-carbon bonds present. In one especially preferred embodiment, the hydrocarbyl group R is substantially free of carbon to carbon unsaturation. It is to be understood that, within the context of this invention, aromatic unsaturation is not normally considered to be olefinic unsaturation. That is, aromatic groups are not considered as having carbon-to-carbon unsaturated bonds.

Preferably, hydrocarbyl groups R are substantially aliphatic in nature, that is, they contain no more than one non-aliphatic (cycloalkyl, cycloalkenyl or aromatic) group for every 10 carbon atoms in the R group. Usually, however, the R groups contain no more than one such non-aliphatic group for every 50 carbon atoms, and in many cases, they contain no such non-aliphatic groups; that is, the typical R group is purely aliphatic. These purely aliphatic R groups are alkyl or alkenyl groups.

Specific non-limiting examples of substantially saturated hydrocarbyl R groups are: methyl, tetra (propylene), nonyl, triisobutyl, oleyl, tetracontanyl, henpentacontanyl, a mixture of poly(ethylene/propylene) groups of about 35 to about 70 carbon atoms, a mixture of the oxidatively or mechanically degraded poly(ethylene/propylene) groups of about 35 to about 70 carbon atoms, a mixture of poly (propylene/1-hexene) groups of about 80 to about 150 carbon atoms, a mixture of poly(isobutene) groups having between 20 and 32 carbon atoms, and a mixture of poly(isobutene) groups having an average of 50 to 75 carbon atoms. A preferred source of hydrocarbyl groups R are polybutenes obtained by polymerization of a $C_4$ refinery stream having a butene content of 35 to 75 weight percent and isobutene content of 15 to 60 weight percent in the presence of a Lewis acid catalyst such as aluminum trichloride or boron trifluoride. These polybutenes contain predominantly (greater than 80% of total repeating units) isobutene repeating units of the configuration

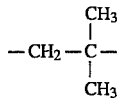

These polybutenes are typically monoolefinic. In one embodiment, the monoolefinic groups are vinylidene groups, i.e., groups of the formula

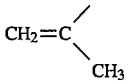

although the polybutenes may also comprise other olefinic configurations.

In one embodiment the polybutene is substantially monoolefinic, comprising at least about 50% vinylidene groups, more preferably at least about 80% vinylidene groups.

The attachment of a hydrocarbyl group R to the aromatic moiety Ar of the compounds of formula (I) of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol in the presence of a Lewis acid catalyst. Methods and conditions for carrying out such reactions are well known to those skilled in the art. See, for example, the discussion in the article entitled, "Alkylation of Phenols" in "Kirk-Othmer Encyclopedia of Chemical Technology", Third Edition, Vol. 2, pages 65–66, Interscience Publishers, a division of John Wiley and Company, N.Y., and U.S. Pat. Nos. 4,379,065; 4,663,063; and 4,708,809, all of which are expressly incorporated herein by reference for relevant disclosures regarding alkylation of aromatic compounds. Other equally appropriate and convenient techniques for attaching the hydrocarbon-based group R to the aromatic moiety Ar will occur readily to those skilled in the art.

The Groups Z

Each Z is independently OH, lower alkoxy, $(OR^5)_bOR^6$, or $O^-$ wherein each $R^5$ is independently a divalent hydrocarbyl group, $R^6$ is H or hydrocarbyl and b is a number ranging from 1 to about 30.

The subscript c indicates the number of Z groups that may be present as substituents on each Ar group. There will be at least one Z group substituent, and there may be more, depending on the value of the subscript m. For the purposes of this invention, c is a number ranging from 1 to about 3. In a preferred embodiment, c is 1.

As will be appreciated from the foregoing, the compounds of formula (I) employed in this invention contain at least two Z groups and may contain one or more R groups as defined hereinabove. Each of the foregoing groups must be attached to a carbon atom which is a part of an aromatic nucleus in the Ar group. They need not, however, each be attached to the same aromatic nucleus if more than one aromatic nucleus is present in the Ar group.

As mentioned hereinabove, each Z group may be, independently, OH lower alkoxy, $O^-$, or $(OR^5)_bOR^6$ as defined hereinabove. In a preferred embodiment, each Z is OH another embodiment, each Z may be $O^-$. In another preferred embodiment, at least one Z is OH and at least one Z is $O^-$. Alternatively, at least one Z may be a group of the formula $(OR^5)_bOR^6$ or lower alkoxy. As mentioned hereinabove, each $R^5$ is independently a divalent hydrocarbyl group. Preferably, $R^5$ is an aromatic or an aliphatic divalent hydrocarbyl group. Most preferably, $R^5$ is an alkylene group containing from 2 to about 30 carbon atoms, more preferably from 2 to about 8 carbon atoms and most preferably 2 or 3 carbon atoms. $R^6$ is preferably H or alkyl, more preferably H or lower alkyl, that is, containing from 1 to about 7 carbon atoms.

The subscript b typically ranges from 1 to about 30, preferably from 1 to about 10, and most preferably from 1 or 2 to about 5.

The Groups $R^1$, $R^2$ and $R^3$

Each of the groups $R^1$, $R^2$ and $R^3$ is independently H or a hydrocarbyl group. In one embodiment, each of $R^1$, $R^2$ and $R^3$ is, independently, H or a hydrocarbyl group having from 1 to about 100 carbon atoms, more often from 1 to about 24 carbon atoms. In a preferred embodiment, each of the aforementioned groups is independently hydrogen or alkyl or an alkenyl group. In one preferred embodiment each of $R^1$, $R^2$ and $R^3$ is, independently, H or lower alkyl. In an especially preferred embodiment, each of the aforementioned groups is H. For the purposes of this invention, the term "lower" when used herein in the specification and claims to describe an alkyl or alkenyl group means from 1 to 7 carbon atoms.

The Group $R^4$ $R^4$ is a terminating substituent on an Ar group. As such $R^4$ may be H, hydrocarbyl or any of the groups defined hereinabove as substituents on Ar provided that said substituent is monovalent. Thus, $R^4$ may be any of the optional substituents on Ar referred to hereinabove, as well as R, Z or H. Most often, $R^4$ is H or a hydrocarbyl group, preferably H or lower alkyl, or lower alkenyl, most preferably, H.

The subscript y defines the number of (VII)

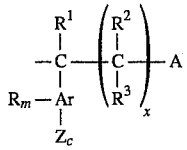

groups present in (I). The number y is at least one, usually a number ranging from 1 to about 10, more often from 1 to about 3, and preferably 1.

The subscript x denotes the number of

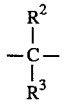

groups present. For the purposes of this invention, x normally ranges from 0 to about 8. In a preferred embodiment, x is 0, 1 or 2. Most preferably x equals 0.

The Group A

The compound of formula (I) contains at least one group A, wherein at least one A is a group characterized by the formula

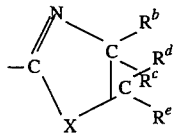

(II)

wherein $R^b$, $R^c$, $R^d$ and $R^e$ are each independently H hydroxyhydrocarbyl or hydrocarbyl groups, and X is O, S or $NR^a$ wherein $R^a$ is H, hydrocarbyl, hydroxyhydrocarbyl, aminohydrocarbyl or a group of the formula $$\text{—}(Y)_a R^5\text{—}D \qquad \text{(III)}$$

wherein each Y is a group of the formula $$\text{—}R^5\text{—}\underset{\underset{R^7}{|}}{N}\text{—} \quad \text{or} \quad \text{—}R^5O\text{—}$$

each $R^5$ is a divalent hydrocarbyl group, each $R^7$ is H, alkoxyalkyl, hydroxyalkyl, a hydrocarbyl group, an aminohydrocarbyl group, or an N-alkoxyalkyl- or hydroxyalkyl- substituted aminohydrocarbyl group, a is 0 or a number ranging from 1 to about 100 and D is a group of the formula

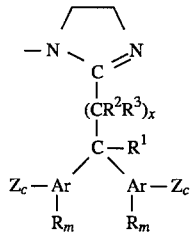

(IV)

Preferably $R^a$ is H, alkyl or alkenyl, hydroxyalkyl, preferably hydroxyloweralkyl, most preferably hydroxyethyl or hydroxypropyl, or a group of the formula $$\text{—}(Y)_a R^5\text{—}D$$

wherein each Y is a group of the formula $$\text{—}R^5\text{—}\underset{\underset{R^7}{|}}{N}\text{—}$$

wherein each $R^5$ is lower alkylene, preferably ethylene, a is a number ranging from 1 to about 3, and D is as defined hereinabove, wherein each Z in D is preferably —OH and c is preferably 1. When y=1, the compound of formula (I) contains one group A, and this one group A is the group of Formula (II). When y is a number greater than 1, the compound of formula (I) contains more than one group A. In that case, at least one A is the group of Formula (II) and the additional A groups may be groups of Formula (II), amide or amide-containing groups, ester groups, carboxyl groups, acylamino groups, imidazoline-containing groups, oxazoline-containing groups or when one Z and A are taken together, a lactone group of the formula

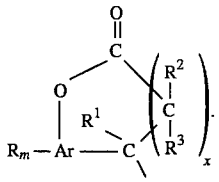

(V)

Preferably each A is a group of Formula (II).

It is to be understood that compounds of formula (I) in mixtures comprising up to about 50% unreacted carboxylic acid groups or lactone are contemplated as being within the scope of this invention. Preferably, any mixture comprising the compound of formula (I) comprises no more than about 30% unreacted carboxylic acid groups or lactone, more preferably, no more than about 15% and even more preferably, no more than about 5% unreacted carboxylic acid or lactone.

In one embodiment y is a number ranging from 2 to about 10 and at least one of the additional A groups has the general formula $$\text{—}\overset{O}{\overset{\|}{C}}\text{—}\overset{R^7}{\overset{|}{N}}(Y)_a R^5\text{—}B \qquad \text{(VIII)}$$

wherein each Y is a group of the formula $$\text{—}R^5\text{—}\underset{\underset{R^7}{|}}{N}\text{—} \quad \text{or} \quad \text{—}R^5O\text{—},$$

each $R^5$ is a divalent hydrocarbyl group and each $R^7$ is H, alkoxyalkyl, hydroxyalkyl, a hydrocarbyl group, an aminohydrocarbyl group or an N-alkoxyalkyl- or hydroxyalkyl-substituted amino hydrocarbyl group, and B is an amide group, an imide-containing group, an amide-containing group or an acylamino group. The subscript a may be 0 or a number ranging from 1 to about 100. More typically, when Y is a group of the formula $$\text{—}R^5\text{—}\underset{\underset{R^7}{|}}{N}\text{—},$$

the subscript "a" ranges from 1 to about 10, more often from 1 to about 6. When Y is —$R^5O$—, the subscript a typically ranges from 1 to about 100, preferably from 10 to about 50.

Preferably, each $R^5$ is lower alkylene such as ethylene, propylene or butylene.

The groups B are preferably selected from acylamino groups of the formula $$-\overset{R^7}{\overset{|}{N}}-\overset{O}{\overset{\|}{C}}-T \qquad \text{(IX)}$$

wherein each $R^7$ is independently H, alkoxyalkyl, hydroxyalkyl, hydrocarbyl, aminohydrocarbyl or an N-alkoxyalkyl- or N-hydroxyalkyl-substituted amino hydrocarbyl group and T is hydrocarbyl, groups of the formula (X)

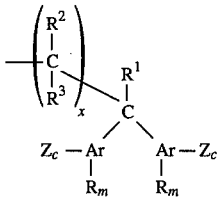

wherein each component of this group is defined hereinabove, or imide-containing groups.

In another embodiment, y is a number ranging from 2 to about 10 and at least one of the additional A groups has the formula $$-\overset{O}{\overset{\|}{C}}-\overset{R^7}{\overset{|}{N}}\text{-}(Y)_a\text{-}R^5-N(R^{11})_2 \qquad \text{(XI)}$$

wherein each Y is a group of the formula $$-R^5-\underset{R^7}{\underset{|}{N}}- \quad \text{or} \quad -R^5O-,$$

each $R^5$ is independently a divalent hydrocarbyl group, each $R^{11}$ is independently H, alkoxyalkyl, hydroxyalkyl or hydrocarbyl and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group and a is as defined hereinabove.

In a further embodiment, y is a number ranging from 2 to about 10 and at least one of the additional A groups is a group of the formula $$-\overset{O}{\overset{\|}{C}}-N(R^5-\overset{H}{\overset{|}{N}})_t H \qquad \text{(XII)}$$

wherein $R^5$ is an ethylene, propylene or butylene group, most preferably ethylene, and t is a number ranging from 1 to about 4.

In still another embodiment, y is a number ranging from 2 to about 10 and at least one of the additional A groups has the formula $$-\overset{O}{\overset{\|}{C}}-\overset{R^7}{\overset{|}{N}}\text{-}(Y)_a\text{-}R^5-OR^9 \qquad \text{(XIII)}$$

wherein each Y is independently a group of the formula $$-R^5-\underset{R^7}{\underset{|}{N}}- \quad \text{or} \quad -R^5O-,$$

each $R^5$ is independently a divalent hydrocarbyl group, each $R^9$ is independently H or hydrocarbyl and each $R^7$ is independently H, alkoxyalkyl, hydroxyalkyl, a hydrocarbyl group, an aminohydrocarbyl group, or an N-alkoxyalkyl- or hydroxyalkyl-substituted aminohydrocarbyl group and a is as defined hereinabove.

In one preferred embodiment at least one, and more preferably each, Ar in formula (I) has the formula

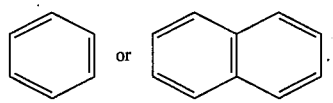

In another preferred embodiment at least one Ar is a linked aromatic group corresponding to the formula $$ar\text{-}(L-ar)_w$$

wherein each element of the formula is as described hereinabove. Preferably each ar is independently a benzene nucleus or a naphthalene nucleus, most preferably a benzene nucleus.

In one particularly preferred embodiment, at least one Ar is a member of the group consisting of a benzene nucleus, a lower alkylene bridged, preferably methylene bridged, benzene nucleus or a naphthalene nucleus.

Most preferably each Ar is a benzene nucleus.

In one particularly preferred embodiment at least one Z is —OH or $(OR^5)_bOR^6$, more preferably —OH. Especially preferred is where each Z is —OH.

In another preferred embodiment, each Z is OH, m and c are each one, x=0, Ar has no optional substituents and $R^1$=H.

In an especially preferred embodiment, each Ar is

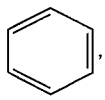

$R^1$ is H or alkyl or alkenyl containing from 1 to about 20 carbon atoms, each R is a hydrocarbyl group containing from 4 to about 300 carbon atoms, preferably from 7 to about 100 carbon atoms, and A is the group of Formula (II). Preferably R is alkyl or substantially saturated alkenyl.

The products of formula (I) of this invention may be readily prepared by reacting (a) reactants of the formula $$R_m-\underset{\underset{(H)_s}{|}}{Ar}-Z_c \quad (XIV)$$

wherein R is independently a hydrocarbyl group as defined hereinabove, m ranges from 0 to about 6, preferably 1 or 2, most preferably 1, Ar is an aromatic group containing from 5 to about 30 carbon atoms and having from 0 to 3 optional substituents selected from the group described hereinabove, wherein s is an integer of at least 1 and c ranges from 1 to about 3, wherein the total of s+m+c does (b) a carboxylic reactant of the formula $$R^1CO(CR^2R^3)_xCOOR^{10} \quad (XV)$$

wherein $R^1$, $R^2$ and $R^3$ are independently H or a hydrocarbyl group, $R^{10}$ is H or an alkyl group, and x is an integer ranging from 0 to about 8 and then reacting the intermediate so formed with an amine, as described in greater detail hereinbelow, to form the product.

When $R^1$ is H, the aldehyde moiety of reactant (XV) may be hydrated. For example, glyoxylic acid is readily available commercially as the hydrate having the formula $$HCOCO_2H.H_2O$$

Glyoxylic acid monohydrate is the preferred reactant and is readily available commercially, for example from Hoechst-Celanese, Aldrich Chemical and Chemie-Linz.

Water of hydration as well as any water generated by the condensation reaction is preferably removed during the course of the reaction.

Ranges of values and descriptions of the groups and subscripts appearing in the above formulae (XIV) and (XV) are the same as recited hereinabove for formulae (I) and (VI). When $R^6$ is an alkyl group it is preferably a lower alkyl group, most preferably, ethyl or methyl.

The reaction to form the intermediate is normally conducted in the presence of a strong acid catalyst. Particularly useful catalysts are illustrated by methanesulfonic acid and para-toluenesulfonic acid. The reaction is usually conducted with the removal of water.

Reactants (a) and (b) are preferably present in a molar ratio of about 2:1; however, useful products may be obtained by employing an excess amount of either reactant. Thus, molar ratios of (a):(b) of 1:1, 2:1, 1:2, 3:1, etc. are contemplated and useful products may be obtained thereby. Illustrative examples of reactants (a) of formula (XIV) include hydroxy aromatic compounds such as phenols, both substituted and unsubstituted within the constraints imposed on Ar hereinabove, alkoxylated phenols such as those prepared by reacting a phenolic compound with an epoxide, and a variety of aromatic hydroxy compounds. In all the above cases, the aromatic groups bearing the Z groups may be single ring, fused ring or linked aromatic groups as described in greater detail hereinabove.

Specific illustrative examples of compound (XIV) employed in the preparation of compounds of formula (I) include phenol, naphthol, 2,2'-dihydroxybiphenyl, 4,4-dihydroxybiphenyl, 3-hydroxyanthracene, 1,2,10-anthracenetriol, resorcinol, 2-t-butyl phenol, 4-t-butyl phenol, 2-t-butyl alkyl phenols, 2,6-di-t-butyl phenol, octyl phenol, cresols, propylene tetramer-substituted phenol, propylene oligomer (MW 300–800)-substituted phenol, polybutene ($M_n$ about 1000)-substituted phenol substituted naphthols corresponding to the above exemplified phenols, methylene-bis-phenol, bis-(4-hydroxyphenyl)-2,2-propane, and hydrocarbon substituted bis-phenols wherein the hydrocarbon substituents are, for example, methyl, butyl, heptyl, oleyl, polybutenyl, etc., sulfide-and polysulfide-linked analogues of any of the above, alkoxylated derivatives of any of the above hydroxy aromatic compounds, etc. Preferred compounds of formula (XIV) are those that will lead to preferred compounds of formula (I). Especially preferred are para-alkyl substituted phenols.

The method of preparation of numerous alkyl phenols is well-known. Illustrative examples of alkyl phenols and related aromatic compounds and methods for preparing same are give in U.S. Pat. No. 4,740,321 to Davis et al. This patent is hereby incorporated herein by reference for relevant disclosures contained therein.

Non-limiting examples of the carboxylic reactant (b) of formula (XV) include glyoxylic acid and other omega-oxoalkanoic acids, keto alkanoic acids such as pyruvic acid, levulinic acid, ketovaleric acids, ketobutyric acids and numerous others. The skilled worker, having this disclosure before him, will readily recognize the appropriate compound of formula (XV) to employ as a reactant to generate a given intermediate. Preferred compounds of formula (XV) are those that will lead to preferred compounds of formula (I).

U.S. Pat. Nos. 2,933,520 (Bader) and 3,954,808 (Elliott et al) describe procedures for preparing the intermediate via reaction of phenol and acid. These patents are expressly incorporated herein for relevant disclosures contained therein.

The intermediate product obtained from the reaction of the foregoing hydroxy aromatic compounds and carboxylic acids is then reacted with an amine. Suitable amine reactants will be described hereinbelow.

Examples of reactants are intended to be illustrative of suitable reactants and are not intended to be, and should not be viewed as, an exhaustive listing thereof.

The intermediate arising from the reaction of (a) and (b) may be a carboxylic acid or a lactone, depending upon the nature of (a). In particular, when (a) is a highly hindered hydroxy aromatic compound, the product from (a) and (b) is often a carboxylic acid. When the hydroxy aromatic reactant (a) is less hindered, a lactone is generated. Para-substituted phenols usually result in lactone formation.

Often, the intermediate arising from the reaction of (a) and (b) is a mixture comprising both lactone and carboxylic acid.

It will be appreciated that the reaction of reactants (a) and (b) will lead to a compound containing a group Z, as described hereinabove except that when the product is a lactone, Z may be absent.

Amine Reactants

Suitable amine reactants have the general formula $$H-X-(CR^{f2}CR^{f2})-NH_2 \quad (XVI)$$

wherein each $R^f$ is independently H, alkoxy- or hydroxyalkyl, containing from about 1 to about 8, preferably from 1 to about 4 carbon atoms, hydrocarbyl, including alicyclic, acyclic or aromatic groups, preferably alicyclic groups containing form 1 to about 24 carbon atoms, N-alkoxyalkyl- or hydroxyalkyl-substituted aminohydrocarbyl, X is selected from O,S or —$NR^a$ wherein $R^a$ is H, hydrocarbyl including alicyclic, acyclic or aromatic groups, preferably alkyl or alkenyl groups containing from 1 to about 24 carbon atoms, preferably from 8 to about 18 carbons, and hydroxyhydrocarbyl or aminohydrocarbyl containing from 1 to about 8, preferably 1 to about 4 carbon atoms, preferably aliphatic carbon atoms.

Illustrative of suitable amine reactants are alkanolamines, mercaptoalkyleneamines and di- and polyamines provided that they are encompassed by the foregoing formula (XVI).

Specific examples of suitable amines include ethanolamine, 2-aminopropanol, 2-methyl-2-amino-propanol, tris(hydroxymethyl)aminomethane, 2-mercaptoethylamine, ethylene diamine, 1-amino-2-methylaminoethane, diethylenetriamine, triethylenetetraamine and analogous ethylene polyamines including amine-bottoms and condensed amines such as those described hereinbelow, alkoxylated ethylenepolyamines such as N-(2-hydroxyethyl)ethylenediamine, and others.

The amine reactant may comprise mixtures of amine reactants, including mixtures containing two or more amines having structures given by formula (XVI) and mixtures of amines of formula (XVI) with other amines, wherein the other amines do not have structures given by formula (XVI). When mixtures of amine reactants are employed, it is required that sufficient amine of formula (XVI) is present in the reaction mixture to convert at least about 50%, based on equivalent amounts of carboxylic acid or lactone in the reaction product of (a) and (b), to product containing a group A of formula (II). Preferably, sufficient amine of formula (XVI) is present such that at least 75%, more preferably at least 90% and even more preferably 95–100% of the lactone or carboxylic acid group containing reaction product of (a) and (b) is converted to product of formula (I) containing groups A having structures given by formula (II).

Suitable other amine reactants, as defined hereinabove, include ammonia, monoamines or polyamines. The monoamines generally contain from 1 to about 24 carbon atoms, preferably 1 to about 12, and more preferably 1 to about 6. Examples of monoamines useful in the present invention include methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary monoamines will only form salts, for example, with carboxylic acid groups.

In another embodiment, the monoamine may be a hydroxyamine. Typically, the hydroxyamines are primary or secondary alkanolamines or mixtures thereof. As stated above, tertiary monoamines will only form salts; however tertiary alkanol monoamines sometimes can react to form a tertiary amino group containing ester. They tend to resist reaction with the lactone intermediate. However, when the intermediate contains carboxylic acid groups, reaction with the –OH group of alkanolamines can lead to ester formation. Alkanol amines that can react to form other than salts can be represented, for example, by the formulae:

$$H_2N-R'-OH, \text{and}$$

$$\begin{array}{l} H \\ \quad\diagdown \\ \quad\quad N-R'-OH, \\ \quad\diagup \\ R_4 \end{array}$$

wherein each $R_4$ is independently a hydrocarbyl group of one to about 22 carbon atoms or hydroxyhydrocarbyl group of two to about 22 carbon atoms, preferably one to about four, and R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. When two $R^4$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R^4$ is independently a methyl, ethyl, propyl, butyl, pentyl or hexyl group.

Examples of these alkanolamines include di- and triethanolamine, diethylethanolamine, ethylethanolamine, butyldiethanolamine, etc.

The hydroxyamines can also be ether group containing N-(hydroxyhydrocarbyl) amines. These are hydroxypoly-(hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formulae:

$$H_2N-(R'O)_x-H,$$

$$\begin{array}{l} H \\ \quad\diagdown \\ \quad\quad N-(R'O)_x-H, \\ \quad\diagup \\ R_4 \end{array}$$

and $$\begin{array}{l} R_4 \\ \quad\diagdown \\ \quad\quad N-(R'O)_x-H \\ \quad\diagup \\ R_4 \end{array}$$

wherein x is a number from about 2 to about 15 and $R_4$ and R' are as described above. $R_4$ may also be a hydroxypoly-(hydrocarbyloxy) group.

The amine may also be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Other useful amines include ether amines of the general formula $$R_6OR^1NHR_7$$

wherein $R_6$ is a hydrocarbyl group, preferably an aliphatic group, more preferably an alkyl group, containing from 1 to about 24 carbon atoms, $R^1$ is a divalent hydrocarbyl group, preferably an alkylene group, containing from two to about 18 carbon atoms, more preferably two to about 4 carbon atoms and $R_7$ is H or hydrocarbyl, preferably H or aliphatic, more preferably H or alkyl, more preferably H. When $R_7$ is not H, then it preferably is alkyl containing from one to about 24 carbon atoms. Especially preferred ether amines are those available under the name SURFAM produced and marketed by Mars Chemical Co., Atlanta, Ga.

Alkylene polyamines are represented by the formula $$\begin{array}{l} HN-(\text{Alkylene-}\underset{\underset{R_5}{|}}{N})_n-\underset{\underset{R_5}{|}}{} R_5 \end{array}$$

wherein n has an average value between about 1 and about 10, preferably about 2 to about 7, more preferably about 2 to about 5, and the "Alkylene" group has from 1 to about 10 carbon atoms, preferably about 2 to about 6, more preferably about 2 to about 4. $R_5$ is independently hydrogen or an aliphatic or hydroxy-substituted aliphatic group of up to about 30 carbon atoms. Preferably $R_5$ is H or lower alkyl, most preferably, H.

Alkylene polyamines include methylene polyamines, ethylene polyamines, butylene polyamines, propylene polyamines, pentylene polyamines, etc. Higher homologs and related heterocyclic amines such as piperazines and N-amino alkyl-substituted piperazines are also included. Specific examples of such polyamines are tris-(2-aminoethyl)amine, propylene diamine, trimethylene diamine, tripropylene tetramine, etc.

Higher homologs obtained by condensing two or more of the above-noted alkylene amines are similarly useful as are mixtures of two or more of the aforedescribed polyamines.

Ethylene polyamines, such as some of those mentioned above, are preferred. They are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Texas, designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetramine, 21.74% tetraethylene pentaamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation product obtained by reaction of at least one hydroxy compound with at least one polyamine reactant containing at least one primary or secondary amino group. The hydroxy compounds are preferably polyhydric alcohols and amines. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine.

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C. in the presence of an acid catalyst.

The amine condensates and methods of making the same are described in Steckel (U.S. Pat. No. 5,053,152) which is incorporated by reference for its disclosure to the condensates and methods of making.

In another embodiment, the polyamines are hydroxy-containing polyamines. Hydroxy-containing polyamine analogs of hydroxy monoamines, particularly alkoxylated alkylenepolyamines can also be used. Such polyamines can be made by reacting the above-described alkylene amines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N,N-di-(2-hydroxyethyl)-ethylenediamine, 1-(2-hydroxyethyl)piperazine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the polyamine may be a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, N-aminoalkylmorpholines, N-aminoalkylthiomorpholines, N-aminoalkylpiperazines, N,N'-bisaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, or nitrogen with oxygen and/or sulfur in the hetero-atom containing ring, especially the piperidines, piperazines, thiomorpholines, morpholines, pyrrolidines, and the like. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy alkyl substituted heterocyclic polyamines are also useful. Examples include N-hydroxyethylpiperazine and the like.

In another embodiment, the amine is a polyalkene-substituted amine. These Polyalkene-substituted amines are well known to those skilled in the art. They are disclosed in U.S. Pat. Nos. 3,275,554; 3,438,757; 3,454,555; 3,565,804; 3,755,433; and 3,822,289. These patents are hereby incorporated by reference for their disclosure of polyalkene-substituted amines and methods of making the same.

Typically, polyalkene-substituted amines are prepared by reacting halogenated-, preferably chlorinated-, olefins and olefin polymers (polyalkenes) with amines (mono- or polyamines). The amines may be any of the amines described above. Examples of these compounds include poly(propylene)amine; N,N-dimethyl-N-poly(ethylene/propylene)amine, (50:50 mole ratio of monomers); polybutene amine; N,N-di(hydroxyethyl)-N-polybutene amine; N-(2-hydroxypropyl)-N-polybuteneamine; N-polybutene-aniline; N-polybutenemorpholine; N-poly(butene)ethylenediamine; N-poly(propylene)trimethylenediamine; N-poly(butene)diethylenetriamine;N',N'-poly(butene)tetraethylenepentamine;N N-dimethyl-N'-poly(propylene)- 1,3-propylenediamine and the like.

The polyalkene substituted amine is characterized as containing from at least about 8 carbon atoms, preferably at least about 30, more preferably at least about 35 up to about 300 carbon atoms, preferably 200, more preferably 100. In one embodiment, the polyalkene substituted amine is characterized by an $\bar{M}n$ (number average molecular weight) value of at least about 500. Generally, the polyalkene substituted amine is characterized by an $\bar{M}n$ value of about 500 to about 5000, preferably about 800 to about 2500. In another embodiment $\bar{M}n$ varies between about 500 to about 1200 or 1300.

The polyalkenes from which the polyalkene substituted amines are derived include homopolymers and interpolymers of polymerizable olefin monomers of 2 to about 16 carbon atoms; usually 2 to about 6, preferably 2 to about 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the polymer is a homopolymer. An example of a preferred homopolymer is a polybutene, preferably a polybutene in which about 50% of the polymer is derived from isobutylene. The polyalkenes are prepared by conventional procedures.

The compound of Formula (I) forms by reaction of the amine with the lactone intermediate, opening the lactone ring or from direct reaction with a carboxylic acid group. It is generally preferred to utilize sufficient amine reactant to convert substantially all of the carboxylic acid or lactone to product; however, conversion of at least 50%, more preferably 75% of lactone or carboxylic acid to product is often acceptable. Preferably, at least 90%, more preferably 99–100% conversion of lactone or carboxylic acid to product is effected.

The reaction of the lactone or carboxylic acid with an amine to prepare the nitrogen-containing compounds of this invention is conducted at temperatures ranging from about 100° C. to about 250° C., preferably 150° C.–250° C., more preferably 175°–225° C. Imidazoline, thiazoline or oxazoline formation occurs, frequently by first forming the amide then continuing the reaction at elevated temperature to generate imidazoline, thiazoline or oxazoline by eliminating water. Infrared analysis during the reaction is a convenient means for determining the nature and extent of the reaction. The time required for conversion to the nitrogen-containing heterocyclic compound generally decreases with increased temperature.

The following specific illustrative examples describe the preparation of the compounds of formula (I) useful in the fuel compositions of this invention. In the following examples, as well as in the claims and in the specification of this application, unless otherwise indicated, parts are parts by weight, the temperature is degrees Celsius and the pressure is atmospheric. Where numerical values of pressure are given, they are expressed in millimeters mercury pressure and in kiloPascal (kPa). In several examples, amounts of liquids are given as parts by volume. In those examples, the relationship between parts by weight and parts by volume is as grams and milliliters.

As will be readily apparent to those skilled in the art, variations of each of the illustrated reactants and combination of reactants and conditions may be used.

EXAMPLE 1

To a reactor equipped with a stirrer, thermowell, subsurface gas inlet tube and Dean-Stark trap with condenser are charged 5498 parts of a polybutene substituted phenol prepared by $BF_3$ catalyzed alkylation of phenol with a polybutene having a number average molecular weight of approximately 1000 (vapor phase osmometry-VPO) and containing 1.51 percent OH, 361 parts 50 percent aqueous glyoxylic acid (Aldrich) and 3.7 parts paratoluene sulfonic acid monohydrate (Eastman). The materials are heated under nitrogen to 150° C. and held at 150°–160° C. for 7 hours, collecting 245 parts by volume water in the Dean-Stark trap. The reaction product is filtered at 140°–150° C. employing a diatomaceous earth filter aid. Gel permeation chromatography (GPC) shows 100 percent centered at 3022 molecular weight.

To another reactor equipped as above are charged 1200 parts of the above reaction product and 54 parts diethylene triamine (Union Carbide). The materials are heated under nitrogen to 210° C. and held at 210°–220° C. for 8 hours, collecting 16 parts distillate in the Dean-Stark trap. The materials are cooled to 160° C. at which time 413 parts toluene are added. The product is vacuum filtered at 120°–125° C. and 120 millimeters mercury pressure (16 kPa) employing a diatomaceous earth filter aid. The filtrate contains 1.04% N, by analysis.

EXAMPLE 2

An intermediate is prepared by reacting at 145°–150° C. for 10 hours 2215 parts of the polybutene-substituted phenol described in Example 1 and 137 parts 50 percent aqueous glyoxylic acid (Aldrich) in the presence of 1.5 parts paratoluene sulfonic acid for a period of 10 hours, collecting 91 parts water in a Dean-Stark trap. The saponification number of this product is 25.3.

To another reactor are charged 1145 parts of the foregoing reaction product and 36.5 parts of a mixture of commercial ethylene polyamines having from 3 to about 10 nitrogen atoms per molecule and a nitrogen content of about 35 percent. The materials are heated under nitrogen to 155° C. and held at 155°–160° C. for 8 hours, collecting 3.3 parts water in a Dean-Stark trap. The mixture is heated further to 170° C. and held at 170°–185° C. for 2 hours. Xylene (495 parts) is added and the solution is vacuum filtered employing a diatomaceous earth filter aid.

EXAMPLE 3

The process of Example 2 is repeated employing 1050 parts of the polybutene-substituted phenol-glyoxylic acid reaction product, 20.9 parts of the amine mixture and 356 parts xylene.

EXAMPLE 4

A reactor is charged with 2222 parts of the polybutene substituted phenol and 146 parts of the 50 percent aqueous glyoxylic acid described in Example 1, 1.5 parts paratoluene sulfonic acid monohydrate and 600 parts by volume xylene. The materials are heated under nitrogen at reflux (170° C. maximum) for 7 hours, collecting 103 parts water in a Dean-Stark trap. The materials are cooled to 25° C., followed by addition of 208.5 parts of ethylene polyamine bottoms identified as HPA-X (Union Carbide), which has an equivalent weight, per nitrogen, of 40.5. Following refluxing at 170° C. maximum for 12 hours, the materials are vacuum stripped to 170° C. over 3 hours, 1666 parts mineral oil diluent are added and the oil solution is filtered employing a diatomaceous earth filter aid at 140°– 150° C.

EXAMPLE 5

To a reactor equipped as described in Example 1 are charged 1350 parts of polybutene-substituted phenol and 89 parts 50 percent aqueous glyoxylic acid as described in Example 1, 0.9 parts paratoluene sulfonic acid monohydrate (Eastman) and 400 parts by volume xylene, followed by heating under nitrogen at reflux (maximum temperature 170° C.) for 5 hours while collecting 63 parts water in a Dean-Stark trap. The reaction mixture is cooled, 125.4 parts tetraethylenepentylamine are added and the materials are again heated at reflux (maximum temperature 170° C.) for 15 hours. Solvent is removed by stripping to 150° C. at 30 millimeters mercury (4 kPa) over 4 hours followed by addition of 1002 parts mineral oil diluent, and filtration at 120°–130° C. employing a diatomaceous earth filter aid. The filtrate contains, by analysis, 1.67 percent nitrogen.

EXAMPLE 6

To a reactor as described in Example 1 are charged 300 parts of the polyisobutene-substituted phenol-glyoxylic acid reaction product described in Example 1, 13.6 parts of aminoethylethanolamine and 70 parts by volume toluene. The materials are heated under nitrogen to 215° C. and held at 215°–225° C. for 14 hours while collecting 2.6 parts water in a Dean-Stark trap. The materials are cooled then vacuum stripped to 160° C. at 25 millimeters mercury pressure (3.3 kPa) over 3 hours. Xylene, 103.3 parts is added to the residue, mixed thoroughly and the product is vacuum filtered at 130° C. at 120 millimeters mercury pressure (16 kPa) employing a diatomaceous earth filter aid. The filtrate contains, by analysis, 0.82% nitrogen.

EXAMPLES 7–13

Reaction products are prepared substantially according to the procedure of Example 1, replacing the polybutene substituted phenol with an equivalent amount, based on the molecular weight, of the alkylated hydroxy aromatic compounds listed in the following Table I

TABLE I

| Example | Name | Mol. Wt.[1] |
|---|---|---|
| 7 | 2,2'-di(polyisobutene)yl-4,4'-dihydroxybiphenyl | 2500 |
| 8 | 8-hydroxy-poly(propene)yl-1-azanaphthalene | 900 |
| 9 | 4-poly(isobutene)yl-1-naphthol | 1700 |
| 10 | 2-poly(propene/butene-1)yl-4,4'-isopropylidene-bisphenol[2] | 3200 |
| 11 | 4-tetra(propene)yl-2-hydroxy-anthracene | — |
| 12 | 4-octadecyl-1,3-dihydroxybenzene | — |
| 13 | 4-poly(isobutene)-3-hydroxy-pyridine | 1300 |

[1]Number average molecular weight by vapor phase osmometry
[2]The molar ratio of propene to butene-1 in the substituent is 2:3.

EXAMPLE 14

The procedure of Example 2 is repeated except the polybutene has an average molecular weight of about 1400.

EXAMPLE 15

The procedure of Example 5 is repeated employing a substituted phenol (having an —OH content of 1.88%, prepared by reacting polyisobutenyl chloride having a viscosity at 99° C. of 1306 SUS (Sayboldt Universal Seconds) and containing 4.7% chlorine with 1700 parts phenol).

EXAMPLE 16

The procedure of Example 2 is repeated replacing the polybutene substituted phenol with an equivalent number of moles of a sulfurized alkylated phenol prepared by reacting 1000 parts of a propylene tetramer substituted phenol as described with 175 parts of sulfur dichloride and diluted with 400 parts mineral oil.

EXAMPLE 17

The procedure of Example 16 is repeated replacing the sulfurized phenol with a similar sulfurized phenol prepared by reacting 1000 parts of propylene tetramer substituted phenol with 319 parts of sulfur dichloride.

EXAMPLE 18

The procedure of Example 1 is repeated replacing glyoxylic acid with an equivalent amount, based on —COOH, of pyruvic acid.

EXAMPLE 19

The procedure of Example 4 is repeated replacing glyoxylic acid with an equivalent amount , based on —COOH, of levulinic acid.

EXAMPLES 20–22

The procedure of Example 2 is repeated employing the keto alkanoic acids given in Table II.

TABLE II

| Example | Acid |
|---|---|
| 20 | Pyruvic |
| 21 | 3-Ketobutyric |
| 22 | Keto valeric |

EXAMPLE 23

The procedure of Example 3 is repeated replacing glyoxylic acid with an equivalent amount, based on —COOH, of omega-oxo-valeric acid.

EXAMPLES 24–27

The procedures of each of Examples 1–4 are repeated replacing the alkylated phenol with a propylene tetramer-substituted catechol.

EXAMPLE 28

A reactor is charged with 600 parts of the reaction product of Example 1 and the materials are heated to 120° C. under nitrogen. Propylene oxide (24 parts) is added at 120°–130° C. over 4 hours, followed by heating at 120°–130° C. for 3 additional hours.

EXAMPLE 29

A reactor is charged with 800 parts of the reaction product from Example 5. The materials are heated under nitrogen to 125° C. followed by the addition of 23.7 parts propylene oxide over a 6 hour period at 125°–130° C. A dry-ice condenser is employed. The reaction mixture is heated to 130° C. and held at 130°–135° C. for 6 additional hours. The materials are filtered employing diatomaceous earth at 130°–135° C. The materials contain, by analysis, 1.60 percent nitrogen.

EXAMPLE 30

Following substantially the same procedure as described in Example 28, 600 parts of the reaction product from Example 1 are reacted with 12 parts of propylene oxide.

EXAMPLE 31

A one-liter flask equipped with stirrer, reflux condenser and thermometer is charged with 308 parts of a polybutene phenol-glyoxylic acid reaction product prepared as in Example 1 and 9.82 parts triethylene tetraamine. The materials are heated under nitrogen at 120°–130° C. for 7 hours. The infrared spectrum shows no lactone carbonyl remains. The materials are diluted with 106 parts xylene and stirred for 2 hours at 90°–100° C.

Another one liter flask equipped as above except also having a Dean-Stark trap is charged with 280 parts of the above xylene solution. The materials are heated under $N_2$ at 220°–225° C. for 7 hours while collecting 0.5 parts of water. The materials are cooled, weighed to determine amount of xylene lost during reaction and 71.5 parts xylene is added to bring xylene to 25% of total weight. The product contains, by analysis, 0.59% N and has a neutralization number (basic) of 3.65.

As indicated hereinabove, the compounds of this invention may be used as additives for normally liquid fuels.

The fuels used in the fuel compositions of this invention are well known to those skilled in the art and usually contain a major portion of a normally liquid fuel such as hydrocarbonaceous petroleum distillate fuel (e.g., motor gasoline as defined by ASTM Specifications D-439-89 and D-4814-91 and diesel fuel or fuel oil as defined in ASTM Specifications D-396-90a and D-975-91). Fuels containing non-hydrocarbonaceous materials such a alcohols, ether, organo-nitro compounds and the like (e.g., methanol, ethanol, diethyl ether, methyl ethyl ether, nitromethane) are also within the scope of this invention as are liquid fuels derived from vegetable or mineral sources. Vegetable or mineral sources include, for example, crude petroleum oil, coal, corn, shale, oilseeds and other sources.

Oxygenates are compounds covering a range of alcohol and ether type compounds. They have been recognized as means for increasing octane value of a base fuel. They have also been used as the sole fuel component, but more often as a supplemental fuel used together with, for example, gasoline to form the well-known "gasohol" blend fuels. Oxygenate-containing fuels are described in ASTM D-4814-91.

Methanol and ethanol are the most commonly used oxygenates. They are primarily used as fuels. Other oxygenates, such as ethers, for example methyl-t-butyl ether, are more often used as octane number enhancers for gasoline.

Mixtures of fuels are useful. Examples of fuel mixtures are combinations of gasoline and ethanol, diesel fuel and ether, gasoline and nitromethane, etc.

Particularly preferred fuels are gasoline, that is, a mixture of hydrocarbons having an ASTM boiling point of 60° C. at the 10% distillation point to about 205° C. at the 90% distillation point, oxygenates, and gasoline-oxygenate blends, all as defined in the aforementioned ASTM Specifications for automotive gasolines. Most preferred is gasoline.

The fuel compositions of the present invention may contain other additives which are well known to those of skill in the art. These can include anti-knock agents such as tetra-alkyl lead compounds, lead scavengers such as haloalkanes, dyes, antioxidants such as hindered phenols, rust inhibitors such as alkylated succinic acids and anhydrides and derivatives thereof, bacteriostatic agents, auxiliary dispersants and detergents, gum inhibitors, fluidizer oils, metal deactivators, demulsifiers, anti-icing agents and the like. The fuel compositions of this invention may be lead-containing or lead-free fuels. Preferred are lead-free fuels.

As mentioned hereinabove, in one embodiment of this invention, the motor fuel compositions contain an amount of additives sufficient to provide total intake system cleanliness. In another embodiment, they are used in amounts sufficient to prevent or reduce the formation of intake valve deposits or to remove them where they have formed.

As mentioned hereinabove, fluidizer oils may be used in the fuel compositions of the instant invention. Useful fluidizer oils include natural oils or synthetic oils, or mixtures thereof. Natural oils include mineral oils, vegetable oils, animal oils, and oils derived from coal or shale. Synthetic oils include hydrocarbon oils such as alkylated aromatic oils, olefin oligomers, esters, including esters of polycarboxylic acids and polyols, and others.

Especially preferred mineral oils are paraffinic oils containing no more than about 20% unsaturation, that is, no more than 20% of the carbon to carbon bonds are olefinic.

Particularly useful synthetic oils are the polyether oils such as those marketed under the UCON tradename by Union Carbide Corporation and polyester oils derived from a polyol and one or more monocarboxylic acids such as those marketed by Hatco Corporation.

Preferably, the fluidizer oils have a kinematic viscosity ranging from about 2 to about 25 centistokes at 100° C., preferably from about 4 to about 20 centistokes, and often up to about 15 centistokes. If the viscosity of the fluidizer oil is too high, a problem that may arise is the development of octane requirement increase (ORI) wherein the octane value demands of the engine tend to increase with time of operation.

While both mineral oils and synthetic oils are generally useful as fluidizer oils over the entire preferred viscosity range, it has been observed that at the lower end of the viscosity range, synthetic oils tend to provide somewhat superior performance compared to mineral oils.

It has been found that fluidizer oils, particularly when used within the ranges specified herein, together with the compounds of this invention, improve detergency and reduce the tendency toward valve sticking. Amounts of the various additives, including individual amounts to be used in the fuel composition, and relative amounts of additives are given hereinafter.

The fuel compositions of this invention may contain auxiliary dispersants. A wide variety of dispersants are known in the art and may be used together with the amide compounds described herein. Preferred auxiliary dispersants are Mannich type dispersants, acylated nitrogen-containing dispersants, aminophenol dispersants, aminocarbamate dispersants, ester dispersants and amine dispersants.

Acylated nitrogen-containing compounds include reaction products of hydrocarbyl-substituted carboxylic acylating agents such as substituted carboxylic acids or derivatives thereof with ammonia or amines. Especially preferred are succinimide dispersants.

Acylated nitrogen-containing compounds are known in the art and are disclosed in, for example, US Pat. Nos. 4,234,435; 3,215,707; 3,219,666; 3,231,587 and 3,172,892, which are hereby incorporated by reference for their disclosures of the compounds and the methods of preparation.

The auxiliary dispersant may also be an ester. These compounds are prepared by reacting a hydrocarbyl-substituted carboxylic acylating agent with at least one organic hydroxy compound. In another embodiment, the ester dispersant is prepared by reacting the acylating agent with a hydroxyamine. Preferred are succinic esters.

Carboxylic esters and methods of making the same are known in the art and are disclosed in U.S. Pat. Nos. 3,219,666, 3,381,022, 3,522,179 and 4,234,435 which are hereby incorporated by reference for their disclosures of the preparation of carboxylic ester dispersants.

The carboxylic esters may be further reacted with at least one amine and preferably at least one polyamine. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

Also included among the auxiliary dispersants are Mannich type dispersants. Mannich products are formed by the reaction of at least one aldehyde, at least one amine having at least one N—H group and at least one hydroxyaromatic compound.

Mannich products are described in the following patents: U.S. Pat. Nos. 3,980,569; 3,877,899; and 4,454,059 (herein incorporated by reference for their disclosure to Mannich products).

The auxiliary dispersant may be a polyalkene-substituted amine. Polyalkene-substituted amines are well known to those skilled in the art. Typically, polyalkene-substituted amines are prepared by reacting olefins and olefin polymers (polyalkenes) and halogenated derivatives thereof with amines (mono- or polyamines). These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

Aminophenols are also included among useful auxiliary dispersants that may be used in the fuel composition of this invention. Typically, such materials are prepared by reducing hydrocarbyl substituted nitrophenols to the corresponding aminophenol. Useful aminophenols include those described in Lange, U.S. Pat. Nos. 4,320,000 and 4,320,021. Aminophenols and methods for preparing are also described in U.S. Pat. Nos. 4,100,082 and 4,200,545 to Clason et al, 4,379,065 (Lange) and 4,425,138 (Davis). It should be noted that the term "phenol" used in the context of aminophenols is not intended to limit the compounds referred to in that manner as being only hydroxybenzene derivatives. The term "phenol" is intended to encompass hydroxy aromatic compounds, including hydroxybenzene compounds, naphthols, catechols and others as described in the foregoing patents, all of which are incorporated herein by reference for relevant disclosures contained therein.

Also included among useful auxiliary dispersants are aminocarbamate dispersants such as those described in U.S. Pat. No. 4,288,612, which is incorporated herein by reference for relevant disclosures contained therein.

Treating levels of the additives used in the fuel compositions of this invention are often described in terms of pounds per thousand barrels (PTB) of fuel.

PTB values may be converted to approximate values expressed as parts (by weight) per million parts (by weight) of fuel by multiplying by 4 for gasoline and by 3.3 for diesel oil and fuel oil. To determine precise values it is necessary that the specific gravity of the fuel is known. The skilled person can readily perform the necessary mathematical calculations.

The fuel compositions of this invention contain from about 5 to about 500 pounds per thousand barrels (PTB) of fuel additive, preferably from about 10 to about 250 PTB, more preferably from about 20 to about 100 PTB.

Fluidizer oils, when used, are generally present in amounts ranging from about 1 to about 500 PTB, more often from about 10 to about 250 PTB and most preferably from about 10 to about 150 PTB.

Relative amounts of the compound (I) to fluidizer typically range from about 1:0 to 1:10, more often from about 1:0.1 to 1:5, preferably from about 1:0.1 to 1:2.

The following examples illustrate several fuel compositions of this invention. When referring to examples of compounds described in Examples 1–31, amounts are given in parts and percentages by weight as prepared. Unless indicated otherwise, all other parts and percentages are by weight and amounts of additives are expressed in amounts substantially free of mineral oil or hydrocarbon solvent diluent. The abbreviation 'PTB' means pounds of additive per thousand barrels of fuel.

Table I illustrates several fuel compositions of the instant invention comprising unleaded gasoline and the indicated amounts of additive in pounds per thousand barrels of gasoline.

TABLE I

| PRODUCT OF | GASOLINE + PTB ADDITIVE | | | | | |
|---|---|---|---|---|---|---|
| EXAMPLE | A | B | C | D | E | F |
| 30 | 66.7 | 60 | 60 | | | |
| 1 | | | | 70 | 70 | |
| 6 | | | | | | 95 |
| Polyether oil | | 25 | | 70 | | 25 |
| Xylene | | 30 | 30 | 40 | | 25 |
| Mineral oil | | | 25 | | 45 | |
| Alkylated aromatic hydrocarbon | 66.7 | | | | 40 | |

The following Table illustrates additive concentrates for use in fuels.

TABLE II

| Component | Concentrate (% by Weight) | | | | | | |
|---|---|---|---|---|---|---|---|
| | I | II | III | IV | V | VI | VII |
| Alkylated aromatic hydrocarbon | 50 | 50 | 50 | | 50 | | |
| Product of Example 30 | 50 | 37 | | | | | 45 |
| Product of Example 1 | | | | 45 | 35 | | 35 |
| Product of Example 6 | | 13 | | | 15 | | |
| Polyether oil | | | 50 | | | 45 | |
| Mineral oil | | | | 22 | | 20 | |
| Xylene | | | | 33 | | 35 | 20 |

[1] = HISOL 10, Ashland Chemical Co.
[2] = UCON LB-135, Union Carbide

The lubricating oil compositions of this invention employ, usually in major amounts, an oil of lubricating viscosity, including natural or synthetic lubricating oils and mixtures thereof. Natural oils include animal oils, vegetable oils, mineral oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicone-based oils and mixtures thereof.

Specific examples of oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils", *Lubricant Engineering*, volume 43, pages 184–185, March 1987. This article is herein incorporated by reference for its disclosures relating to lubricating oils. A description of oils of lubricating viscosity occurs in U.S. Pat. No. 4,582,618 (Davis) (column 2, line 37 through column 3, line 63, inclusive), herein incorporated by reference for its disclosure to oils of lubricating viscosity.

The compounds of this invention are useful in lubricating oils. They are used in performance-improving amounts, typically, minor amounts.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition comprising at least one compound of the general formula (I)

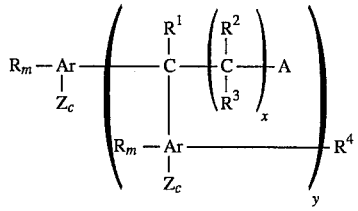

wherein each Ar is independently an aromatic group having from 5 to about 30 carbon atoms having from 0 to 3 optional substituents selected from the group consisting of amino, hydroxy- or alkly- polyoxyalkyl, nitro, aminoalkyl, carboxy or combinations of two or more of said optional substituents, each R is independently a hydrocarbyl group, wherein at least one R contains from 4 to about 750 carbons atoms, $R^1$ is H or a hydrocarbyl group, $R^2$ and $R^3$ are each, independently, H or a hydrocarbyl group, $R^4$ is selected from the group of optional H, a hydrocarbyl group, a member of the group of optional substituents on Ar or lower alkoxy, each m is independently an integer ranging from 1 to about 6, x ranges from 0 to about 8, and each Z is independently OH, lower alkoxy, $(OR^5)_bOR^6$ or O— wherein each $R^5$ is independently a divalent hydrocarbyl group, $R^6$ is H or hydrocarbyl and b is a number ranging from 1 to about 30 and c ranges from 1 to about 3, y is a number ranging from 1 to about 10 and wherein the sum m+c does not exceed the number of valences of the corresponding Ar available for substitution and each A is independently an amide or an amide-containing group, a carboxyl group, an ester group, an acylamino group or a group characterized by the formula (II)

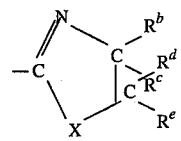

wherein $R^b$, $R^c$, $R^d$ and $R^e$ are each independently H, hydroxyhydrocarbyl or hydrocarbyl groups, X is O, S or $NR^a$ wherein $R^a$ is H, hydrocarbyl, hydroxyhydrocarbyl, aminohydrocarbyl or a group of the formula $$\leftarrow Y\rightarrow_a R^5-D \qquad \text{(III)}$$

wherein each Y is $$-R^5-\underset{\underset{R^7}{|}}{N}- \quad \text{or} \quad -R^5O-$$

each $R^5$ is a divalent hydrocarbyl group each $R^7$ is H, alkoxyalkyl, hydroxyalkyl, a hydrocarbyl group, an aminohydrocarbyl group, or an N-alkoxyalkyl- or hydroxyalkyl-substituted aminohydrocarbyl group, a is 0 or a number ranging from 1 to about 100 and D is a group of the formula (IV)

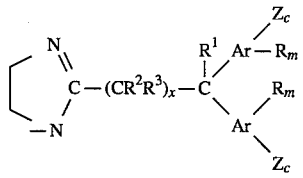

or when one Z and A are taken together, a lactone group of the formula (V)

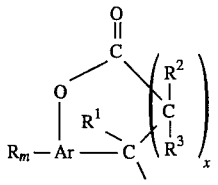

provided at least one A is a group of formula (II).

2. A composition according to claim 1 wherein X in formula (II) is S.

3. A composition according to claim 1 wherein X in formula (II) is N—$R^a$.

4. A composition according to claim 1 wherein X in formula (II) is O.

5. A composition according to claim 1 having at least one R containing from 4 to about 750 carbon atoms.

6. A composition according to claim 5 wherein each R is independently an aliphatic group.

7. A composition according to claim 1 wherein each m is 1 or 2 and each R is an alkyl or alkenyl group.

8. A composition according to claim 7 wherein R contains from 30 to about 100 carbon atoms and is derived from homopolymerized and interpolymerized $C_{2-10}$ olefins.

9. A composition according to claim 8 wherein the olefins are 1-olefins.

10. A composition according to claim 9 wherein the 1-olefins are ethylene, propylene, butenes and mixtures thereof.

11. A composition according to claim 7 wherein R contains from 7 to about 28 carbon atoms.

12. A composition according to claim 7 wherein R contains from 12 to about 50 carbon atoms.

13. A composition according to claim 7 wherein at least one R contains from 7 to about 100 carbon atoms.

14. A composition according to claim 6 wherein each R is a substantially saturated aliphatic group.

15. A composition according to claim 1 wherein each Ar is independently a single ring aromatic group, a fused ring aromatic group or a linked aromatic group.

16. A composition according to claim 15 wherein at least one Ar is a single ring aromatic group.

17. A composition according to claim 16 wherein at least one Ar is a fused ring aromatic group.

18. A composition according to claim 15 wherein at least one Ar is a linked aromatic group corresponding to the formula $$\mathrm{ar}\text{-}(\mathrm{L}-\mathrm{ar})_w$$

wherein each ar is a single ring or a fused ring aromatic nucleus of 5 to about 12 carbons, w is an integer ranging from 1 to about 6 and each L is independently selected from the group consisting of carbon to carbon single bonds between ar nuclei, ether linkages, sulfide linkages, polysulfide linkages, sulfinyl linkages, sulfonyl linkages, lower alkylene linkages, lower alkylene ether linkages, lower alkylene sulfide and/or polysulfide linkages, amino linkages and linkages having the formula (VI)

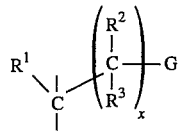

wherein each of $R^1$, $R^2$ and $R^3$ is independently H, alkyl or alkenyl, each G is independently an amide or an amide-containing group, a carboxyl group, an ester group, an oxazoline containing group, a thiazoline containing group, or an imidazoline containing group, and x is an integer ranging from 0 to about 8, and mixtures of such linkages.

19. A composition according to claim 15 wherein at least one Ar is a member of the group consisting of a benzene nucleus, a lower alkylene bridged benzene nucleus or a naphthalene nucleus.

20. A composition according to claim 1 wherein each of $R^1$, $R^2$, $R^3$ and $R^4$ is independently hydrogen or a lower alkyl or alkenyl group.

21. A composition according to claim 1 wherein at least one Z is —OH.

22. A composition according to claim 1 wherein at least one Z is $-(OR^5)_bOR^6$.

23. A composition according to claim 22 wherein $R^5$ is a lower alkylene group and $R^6$ is H or a lower alkyl group.

24. A composition according to claim 19 wherein each Z is OH, m and c are each one, x is 0, and Ar has no optional substituents, and $R^1$=H.

25. A composition according to claim 7 wherein m is 2, and each Ar contains one tertiary-butyl substituent and one alkyl or alkenyl substituent containing from about 4 to about 100 carbon atoms.

26. A composition according to claim 1 wherein y is a number ranging from 2 to about 10 and at least one of the additional A groups has the general formula $$-\overset{O}{\overset{\|}{C}}-\overset{R^7}{\overset{|}{N}}-(Y)_a-R^5-B \qquad \text{(VIII)}$$

wherein each Y is a group of the formula $$-R^5-\underset{R^7}{\underset{|}{N}}- \quad \text{or} \quad -R^5O-,$$

each $R^5$ is a divalent hydrocarbyl group and each $R^7$ is H, alkoxyalkyl, hydroxyalkyl, a hydrocarbyl group, an aminohydrocarbyl group or an N-alkoxyalkyl- or hydroxyalkyl-substituted amino hydrocarbyl group, and B is an amide group, an imide-containing group, an acylamino group or an amide-containing group and a is 0 or a number ranging from 1 to about 100.

27. A composition according to claim 26 wherein the group B is selected from acylamino groups of the formula $$-\overset{R^7}{\overset{|}{N}}-\overset{O}{\overset{\|}{C}}-T \qquad \text{(IX)}$$

wherein $R^7$ is H, alkoxyalkyl, hydroxyalkyl, hydrocarbyl, aminohydrocarbyl or an N-alkoxyalkyl- or N-hydroxyalkyl-substituted amino hydrocarbyl group and T is hydrocarbyl or a group of the formula (X)

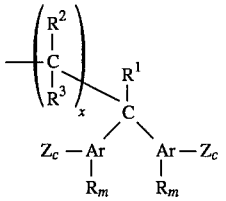

wherein each element of Formula X is defined in claim 1, or an imide containing group.

28. A composition according to claim 1 wherein y is a number ranging from 2 to about 10 and at least one of the additional A groups has the formula $$-\overset{O}{\overset{\|}{C}}-\overset{R^7}{\overset{|}{N}}-(Y)_aR^5-N(R^{11})_2 \quad \text{(XI)}$$

wherein each Y is independently a group of the formula $$-R^5-\underset{R^7}{\underset{|}{N}}- \quad \text{or} \quad -R^5O-,$$

each $R^5$ is independently a divalent hydrocarbyl group, each $R^{11}$ is independently H, alkoxyalkyl, hydroxyalkyl or hydrocarbyl and each $R^7$ is H, alkoxyalkyl, hydroxyalkyl, a hydrocarbyl group, an aminohydrocarbyl group, or an N-alkoxyalkyl- or an N-hydroxyalkyl- or N-hydroxyalkyl- substituted aminohydrocarbyl group and a is 0 or a number ranging from 1 to about 100.

29. A composition according to claim 1 wherein y is a number ranging from 2 to about 10 and at least one of the additional A groups has the formula $$-\overset{O}{\overset{\|}{C}}-\overset{R^7}{\overset{|}{N}}-(Y)_aR^5-OR^9 \quad \text{(XIII)}$$

wherein each Y is independently a group of the formula $$-R^5-\underset{R^7}{\underset{|}{N}}- \quad \text{or} \quad -R^5O-,$$

each $R^5$ is independently a divalent hydrocarbyl group, each $R^9$ is independently H or hydrocarbyl and each $R^7$ is independently H, alkoxyalkyl, hydroxyalkyl, a hydrocarbyl group, an aminohydrocarbyl group, or an N-alkoxyalkyl or hydroxyalkyl substituted aminohydrocarbyl group and a is a number ranging from 0 to about 6.

30. A composition according to claim 3 wherein $R^a$ is an amino hydrocarbyl group of the formula $$(Y)_aR^5-NH_2$$

wherein each Y is a group of the formula $$-R^5-\underset{R^7}{\underset{|}{N}}-$$

wherein each $R^5$ is independently a divalent hydrocarbyl group, each $R^7$ is independently H, aminohydrocarbyl or an N-alkoxyalkyl- or hydroxyalkyl- substituted aminohydrocarbyl group, and a is a number ranging from 0 to about 6.

31. A composition according to claim 1 wherein each of $R^b$, $R^c$, $R^d$ and $R^e$ is independently H or lower alkyl.

32. A composition according to claim 3 wherein $R^a$ is H, lower alkyl, lower alkenyl, aminoalkyl or hydroxyalkyl or a group of the formula $$(Y)_aR^5-D \quad \text{(III)}$$

wherein each Y is a group of the formula $$-R^5-\underset{R^7}{\underset{|}{N}}- \quad \text{or} \quad -R^5O-$$

each $R^5$ is a divalent hydrocarbyl group, each $R^7$ is H, alkoxyalkyl, hydroxyalkyl, a hydrocarbyl group, an aminohydrocarbyl group, or an N-alkoxyalkyl- or hydroxyalkyl- substituted aminohydrocarbyl group, a is 0 or a number ranging from 1 to about 100 and D is a group of the formula (IV)

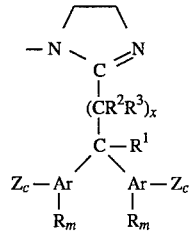

33. A lubricating composition comprising a major amount of an oil of lubricating viscosity and a minor, effective amount, of the composition of claim 1.

34. A process comprising first forming an intermediate by reacting at an elevated temperature (a) at least one reactant of the formula $$R_m-\underset{(H)_s}{\underset{|}{Ar}}-Z_c \quad \text{(XIV)}$$

wherein each R is independently a hydrocarbyl group, m is 0 or a number ranging from 1 to about 6, Ar is an aromatic group containing from 5 to about 30 carbon atoms and having from 0 to 3 optional substituents selected from the group consisting of amino, hydroxy- or alkyl-polyoxyalkyl, nitro, aminoalkyl, carboxy or combinations thereof, wherein s is an integer of at least 1 and c ranges from 1 to about 3 and wherein the sum s+m+c does not exceed the number of valences of Ar available for substitution and each Z is independently selected from the group consisting of OH, lower alkoxy, $(OR^5)_bOR^6$ or $O^-$ wherein each $R^5$ is independently a divalent hydrocarbyl group, $R^6$ is H or hydrocarbyl, b is a number ranging from 1 to about 30, with (b) a carboxylic reactant of the formula $$R^1CO(CR^2R^3)_xCOOR^{10} \quad (XV)$$

wherein $R^1$, $R^2$ and $R^3$ are independently H or a hydrocarbyl group, $R^{10}$ is H or an alkyl group, and x is an integer ranging from 0 to about 8;

then reacting the intermediate so formed at a temperature ranging from about 100° C. to about 250° C. with an amine of the formula $$H-X-(CR_2{}^fCR_2{}^f-)NH_2 \quad (XVI)$$

wherein each $R^f$ is independently H, alkoxy- or hydroxy-alkyl containing from 1 to about 8 carbon atoms, hydrocarbyl, N-alkoxyalkyl- or hydroxyalkyl-substituted aminohydrocarbyl, or aminohydrocarbyl, X is selected from the group consisting of O, S and $NR^a$ wherein each $R^a$ is independently H, hydrocarbyl, hydroxyhydrocarbyl or aminohydrocarbyl containing from 1 to about 8 carbon atoms.

* * * * *